US010188568B2

(12) United States Patent
Krueger et al.

(10) Patent No.: US 10,188,568 B2
(45) Date of Patent: Jan. 29, 2019

(54) COMPACT PROFILE ACTUATION SYSTEM FOR AN ADJUSTABLE BED

(71) Applicant: Ergomotion, Inc., Goleta, CA (US)

(72) Inventors: Joey Krueger, Goleta, CA (US); Brett Anthony Towe, Goleta, CA (US); Hunter Davis Totemeier, Santa Barbara, CA (US); Damien Clenet, Santa Barbara, CA (US); Alain Clenet, Santa Ynez, CA (US)

(73) Assignee: Ergomotion, Inc., Goleta, CA (US)

( * ) Notice: Subject to any disclaimer, the term of this patent is extended or adjusted under 35 U.S.C. 154(b) by 276 days.

(21) Appl. No.: 15/333,542

(22) Filed: Oct. 25, 2016

(65) Prior Publication Data

US 2017/0112695 A1 Apr. 27, 2017

Related U.S. Application Data

(60) Provisional application No. 62/246,215, filed on Oct. 26, 2015.

(51) Int. Cl.

| | |
|---|---|
| ***A61G 7/00*** | (2006.01) |
| ***A61G 7/018*** | (2006.01) |
| ***A61G 7/015*** | (2006.01) |

(52) U.S. Cl.

CPC ..... *A61G 7/018* (2013.01); *A61G 7/015* (2013.01)

(58) Field of Classification Search

CPC ..... A61G 7/00

USPC ..... 5/613, 616–618

See application file for complete search history.

(56) References Cited

U.S. PATENT DOCUMENTS

| | | | | |
|---|---|---|---|---|
| 5,261,725 | A * | 11/1993 | Rudolph | A47C 9/02 297/354.13 |
| 2002/0174487 | A1* | 11/2002 | Kramer | A61G 7/015 5/618 |
| 2006/0026765 | A1* | 2/2006 | Hornbach | A61G 7/015 5/618 |
| 2016/0128883 | A1* | 5/2016 | Robertson | A61G 7/015 5/618 |

* cited by examiner

*Primary Examiner* — Fredrick C Conley
(74) *Attorney, Agent, or Firm* — Felix L. Fischer

(57) ABSTRACT

An articulating bed incorporates a support frame with a head end. Side frame members support and carry a carriage having a seat support. The carriage is mounted with wheels engaging the side frame members to translate from a first position through a range progressing toward the head end to a fully translated position. A first elevating frame rotates about an axle attached to the side frame members with the first elevating frame concealed within a depth profile of the side frame members in an unrotated position. First rollers carried by the carriage engage lower profile surfaces of the elevating frame and a second roller carried by the first elevating frame engages a lower surface of an upper body support pivotally attached to the seat support. Translation of the carriage from the first position to the fully translated position rotates the first elevating frame about the axle to articulate the upper body support.

8 Claims, 19 Drawing Sheets

COMPACT PROFILE ACTUATION SYSTEM FOR AN ADJUSTABLE BED

REFERENCE TO RELATED APPLICATIONS

This application claims priority of U.S. provisional patent application Ser. No. 62/246,215 filed on Oct. 26, 2015 entitled COMPACT PROFILE ACTUATION SYSTEM FOR AN ADJUSTABLE BED, the disclosure of which is incorporated herein by reference.

BACKGROUND

Field

This invention relates generally to the field of adjustable beds and more particularly to a structure for an articulating bed having a compact actuation system incorporating pivoting profiled arms engaged by rollers on a moving carriage for elevation of an upper body portion.

Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

The mechanical structure and drive mechanisms for such articulating beds must be able to support the weight of both a mattress and the occupant. Due to the size, weight, fabrication materials and configuration of the mattress and supporting structure, maintaining rigidity in the system may also be challenging. Typical articulating beds provide an upper body positioning element and a thigh and lower leg positioning element either individually active or with combined actuation. Articulation of the support elements requires actuators which are typically large and require significant angular orientation for leverage and to avoid "dead spots" created by zero angular leverage or overcenter conditions.

However, designs of modern bedding require a reduced thickness profile in side support elements that exposes the actuation system to view.

It is therefore desirable to provide an articulating bed having a compact profile actuation system adapted to be contained within a reduced thickness profile side support.

It is also desirable to provide an articulated bed that is easily configured into different bed sizes. In this case the underlying mechanism and chassis remain the same dimensions while only the body support panels change width.

SUMMARY

The embodiments disclosed herein overcome the shortcomings of the prior art by providing an articulating bed incorporating a support frame with a head end. Side frame members support and carry a carriage having a seat support. The carriage is mounted with wheels engaging the side frame members to translate from a first position through a range progressing toward the head end to a fully translated position. A first elevating frame rotates about an axle attached to the side frame members with the first elevating frame concealed within a depth profile of the side frame members in an unrotated position. First rollers carried by the carriage engage lower profile surfaces of the elevating frame and a second roller carried by the first elevating frame engages a lower surface of an upper body support pivotally attached to the seat support. Translation of the carriage from the first position to the fully translated position rotates the first elevating frame about the axle to articulate the upper body support.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1A:
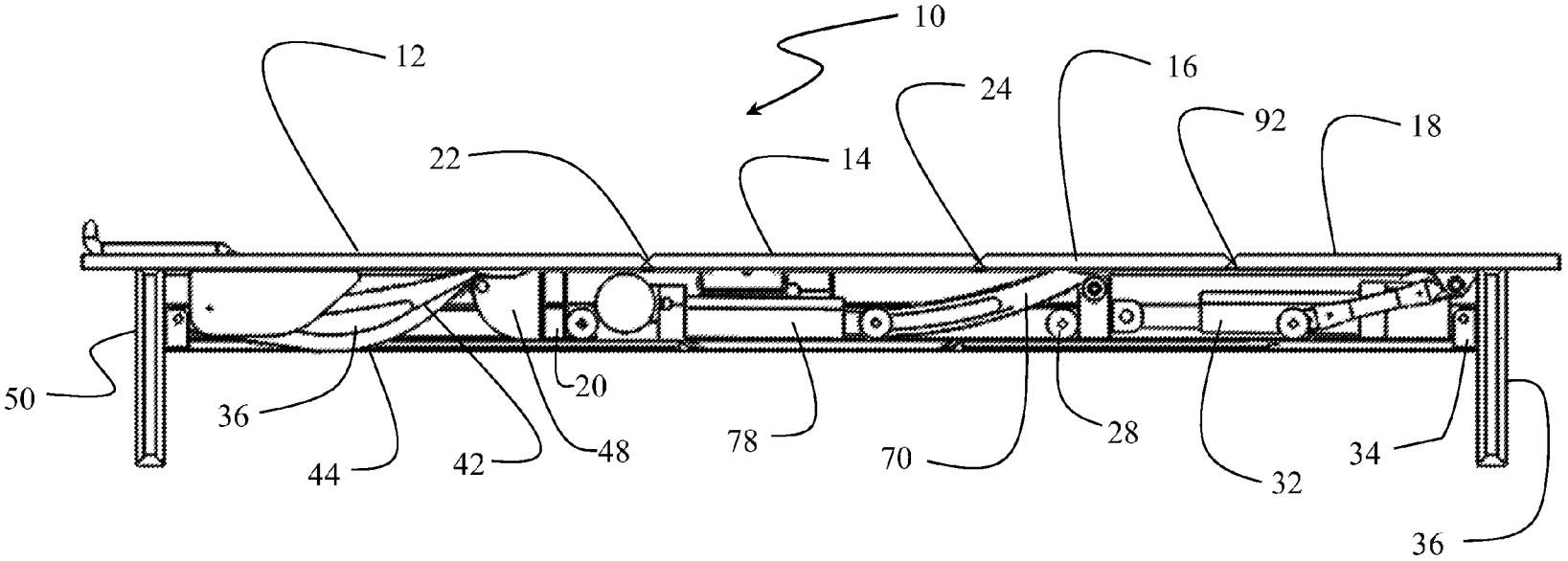
FIG. 1A is a side view of the adjustable bed system in an unarticulated position with the near side frame element and carriage side removed to expose the actuation elements.

Embodiments shown in the drawings and described herein provide an actuation system for an articulating bed which may be implemented in a compact vertical space to present a minimum profile for modern bed designs. Referring to the drawings, FIGS. 1A-1E illustrate an exemplary embodiment of an adjustable bed 10 incorporating the compact profile actuation system with the articulating elements of the bed in various positions. As seen in FIG. 1A, in the unarticulated position, a plurality of mattress support elements are provided; an upper body support 12, a seat support 14, a thigh support 16 and a lower leg support 18. The seat support 14 is mounted to a carriage 20 (best seen in FIG. 1D) with the upper body support 12 engaged to a head end of the seat support by a first hinge 22 and the thigh support 16 engaged to a foot end of the seat support by a second hinge 24. The carriage 20 is carried in the bed 10 by side support rails 26 which receive wheels 28 on horizontal flanges 30 allowing translation of the carriage. A first linear actuator 32 attached to a bracket 34 at a foot end 36 of the bed 10 is attached to a foot end of the carriage 20 to translate the carriage through a range of positions from a first position shown in FIG. 1A to a fully translated position shown in FIG. 1C. With the carriage 20 in the first position the upper body support element 12 is in an unarticulated position as seen in FIGS. 1A and 2A.

Articulation of the upper body support element 12 is accomplished with an elevating frame 36 which is pivotally attached with a first axle 37*at* a first end 38 to a saddle 40. The elevating frame in an unrotated position as shown in FIGS. 1A and 2A has a thickness no greater than and is substantially concealed within a depth 41 of the profile of the side rails 26. The elevating frame 36 has shaped side blades 42 having a curved lower engagement surface 44 received against first rollers 46 mounted to flanges 48 extending from the head end of the carriage 20. As actuator 32 translates the carriage 20 toward the head end 50 of the bed 10, the curved lower engagement surface 44 of the side blades 42 urges the elevating frame 36 to pivot about the saddle 40. Shaping of the curved lower engagement surface 44 provides mechanical advantage inducing upward rotation of the elevating frame from a substantially horizontal position aligned with the side rails 26 and carriage 20. Second roller 52 engages a lower surface 54 of the upper body support 12 causing the upper body support to rotate about first hinge 22 elevating a head end 56 of the upper body support. Second roller 52 may be individual rollers mounted to the side blades 42 or may be a single roller extending between the blades as shown in the drawings. A wedge 58 attached to the lower surface 54 engages the second rollers 52 with a ramp 60. Ramp angle 62 alters the rotation rate of the upper body support 12 which is also translating toward the head end 50. The ramp 60 has a depth no greater than the depth of the side support rails 26

Figure 1B:
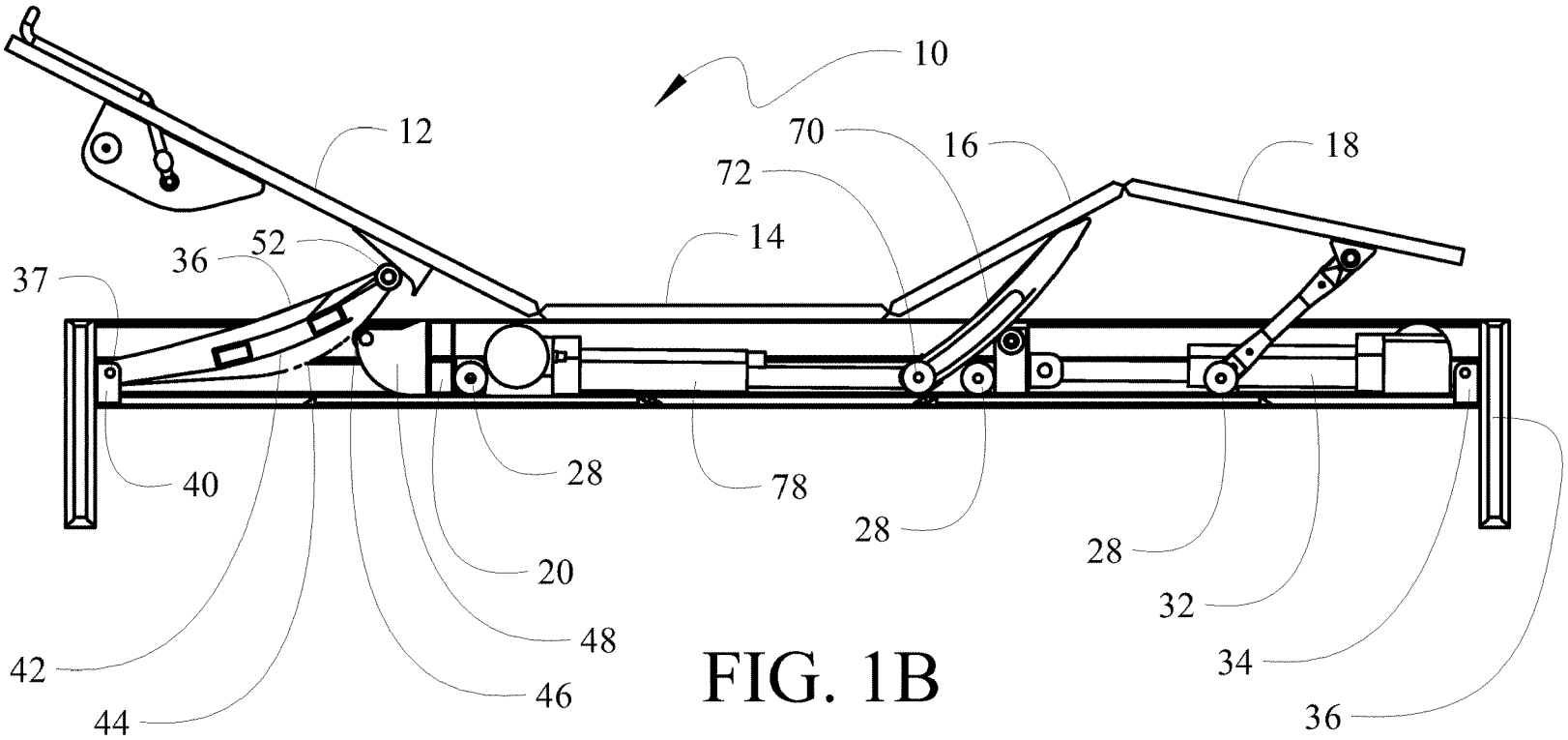
FIG. 1B is a side view of the adjustable bed system of FIG. 1A in a partially articulated position.
Figure 1C:
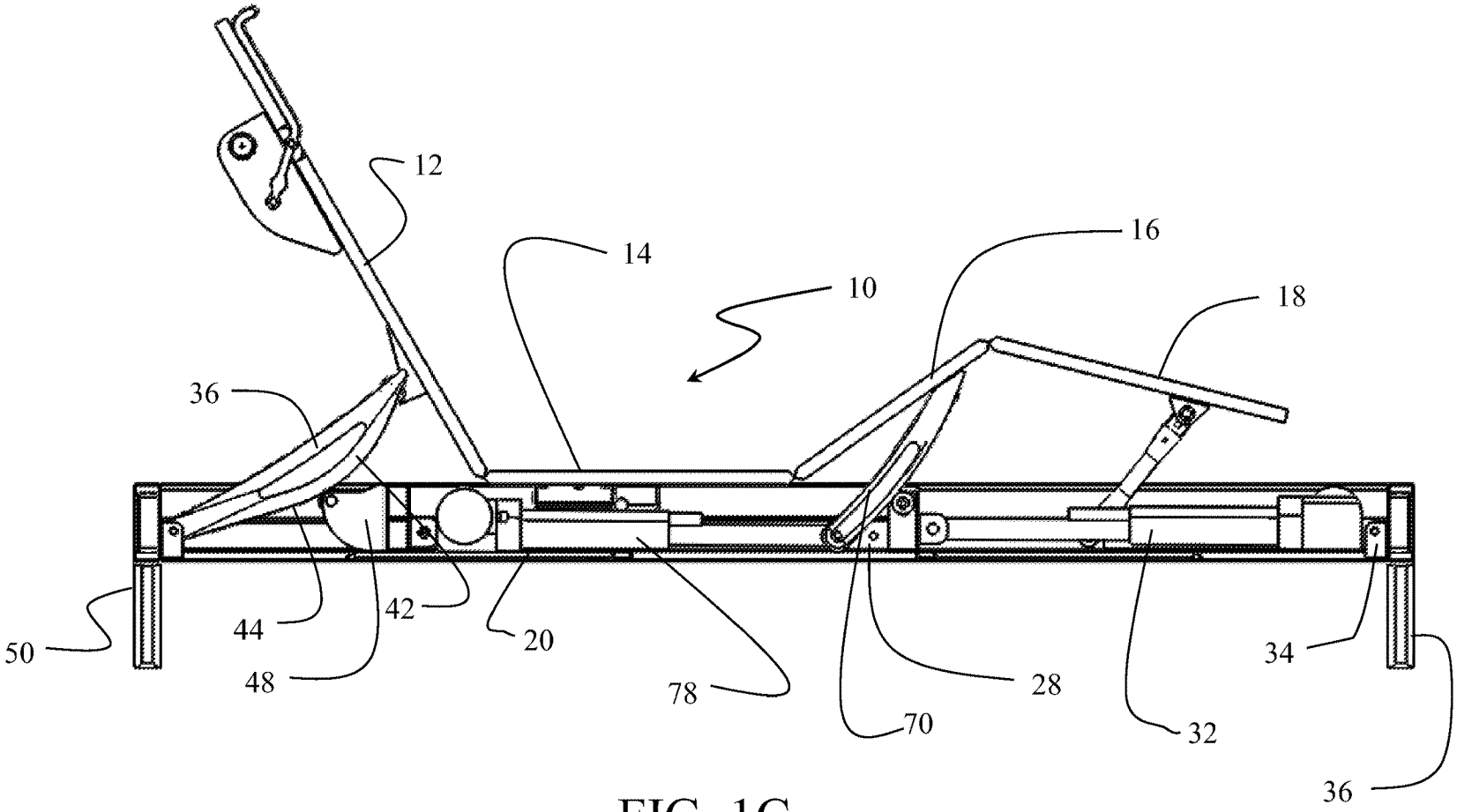
FIG. 1C is a side view of the adjustable bed system of FIG. 1A in a fully articulated position.
Figure 1D:
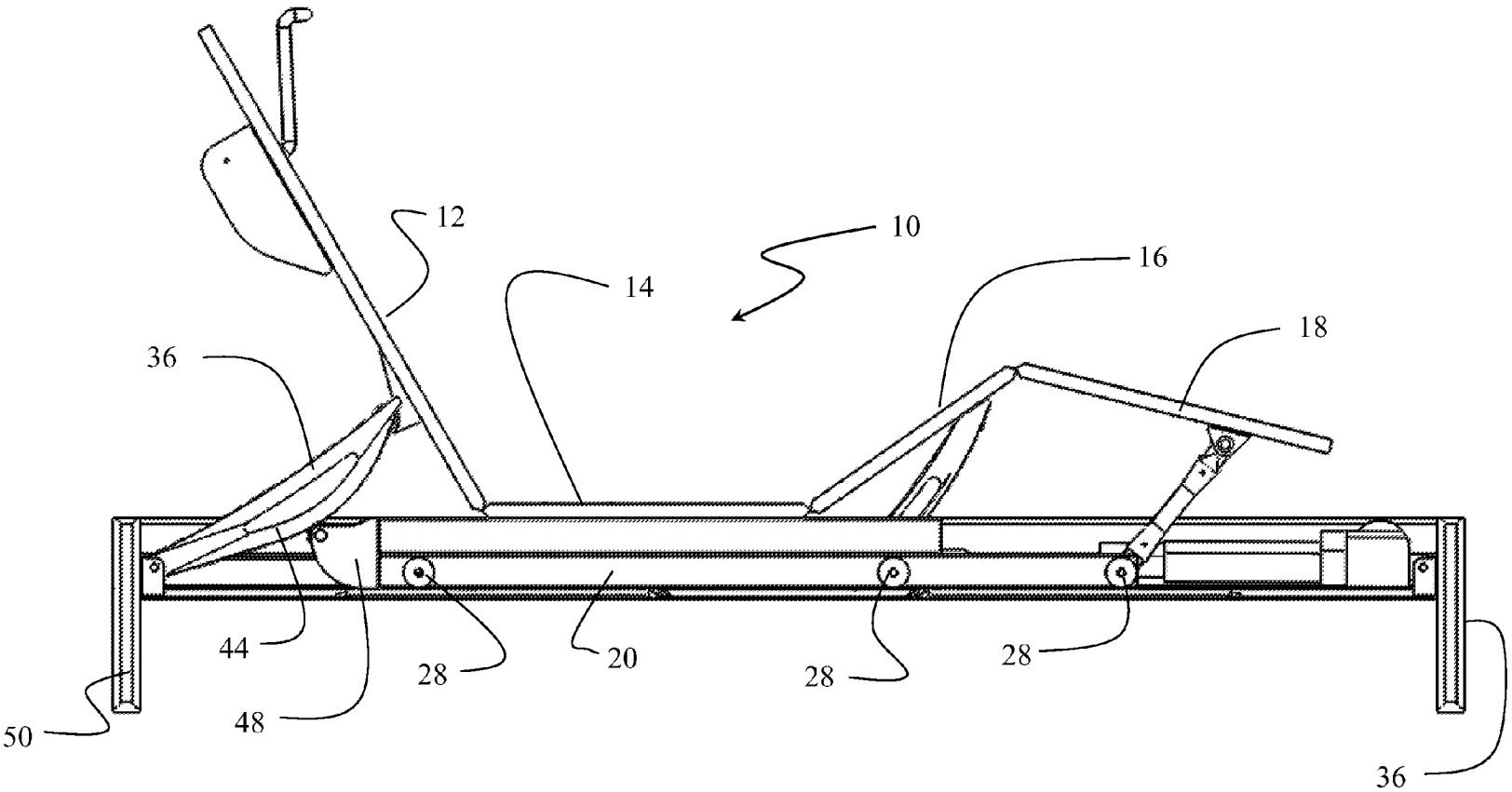
FIG. 1D is a side view of the adjustable bed system in a fully articulated position showing the carriage details with the near side frame element removed to expose the carriage.
Figure 2A:
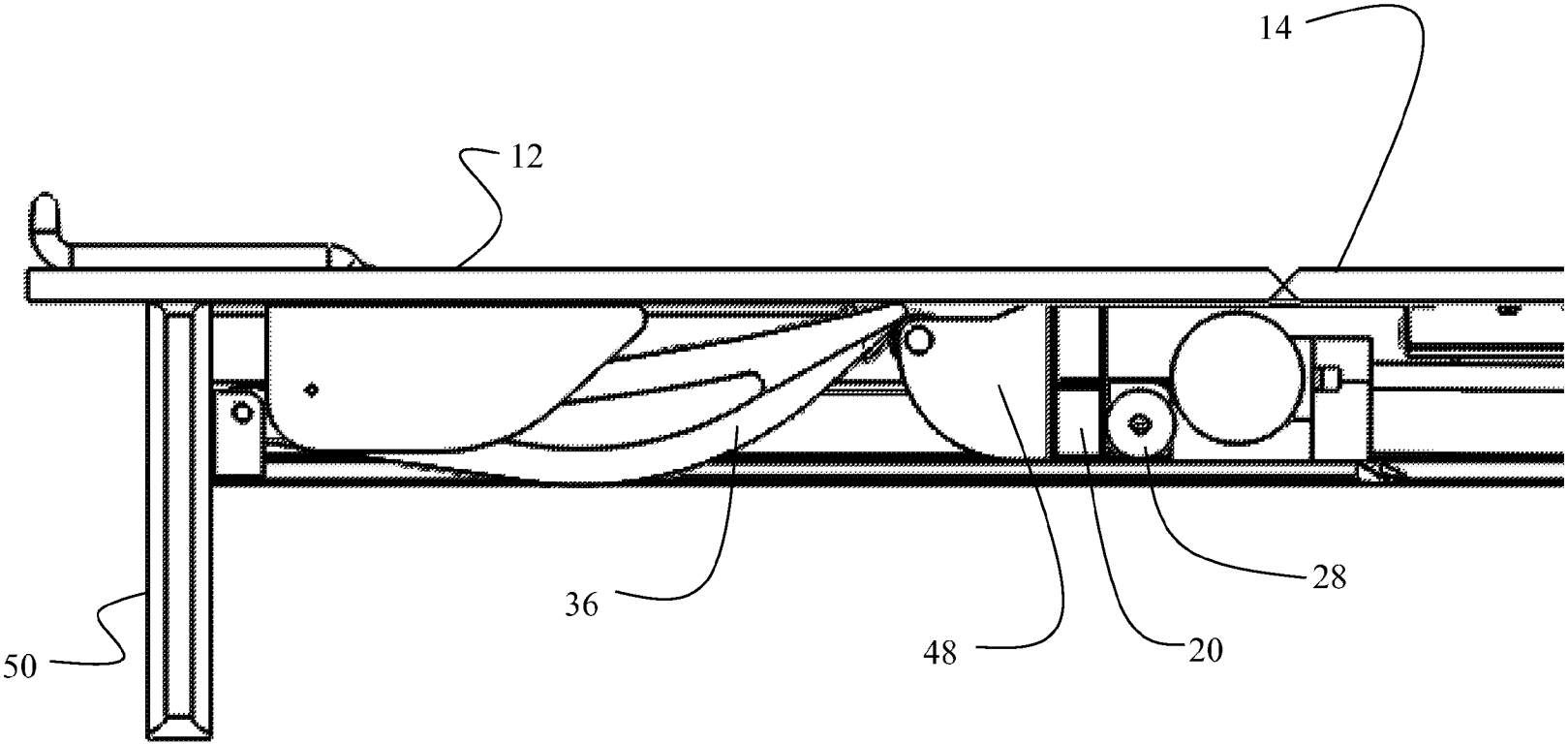
FIG. 2A is a detailed side view of the upper body actuation lever engagement with the carriage in an unarticulated position with the near side frame element and carriage side removed to expose the actuation elements.
Figure 2B:
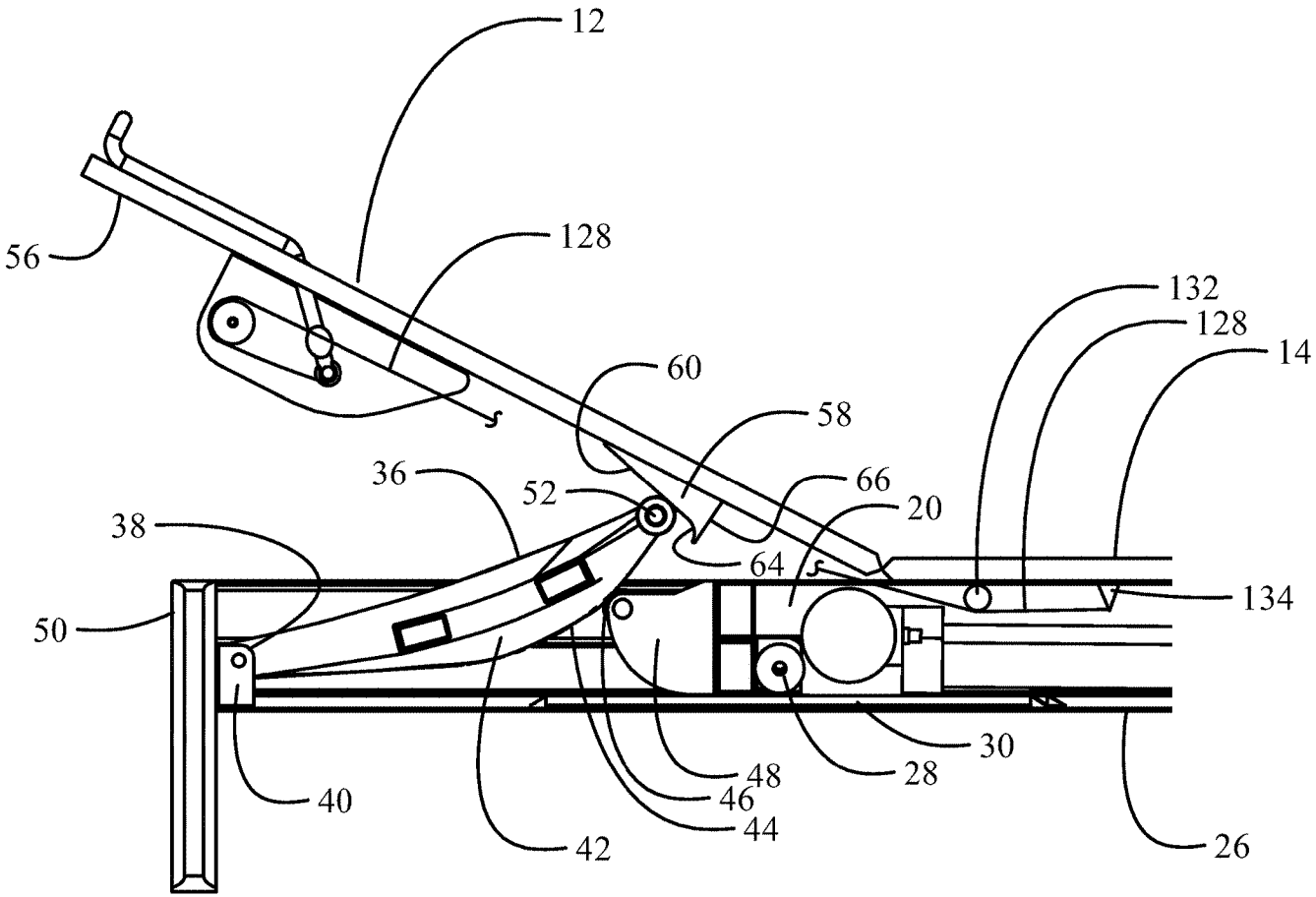
FIG. 2B is a detailed side view of the upper body actuation lever engagement with the carriage in a partially articulated position.
Figure 2C:
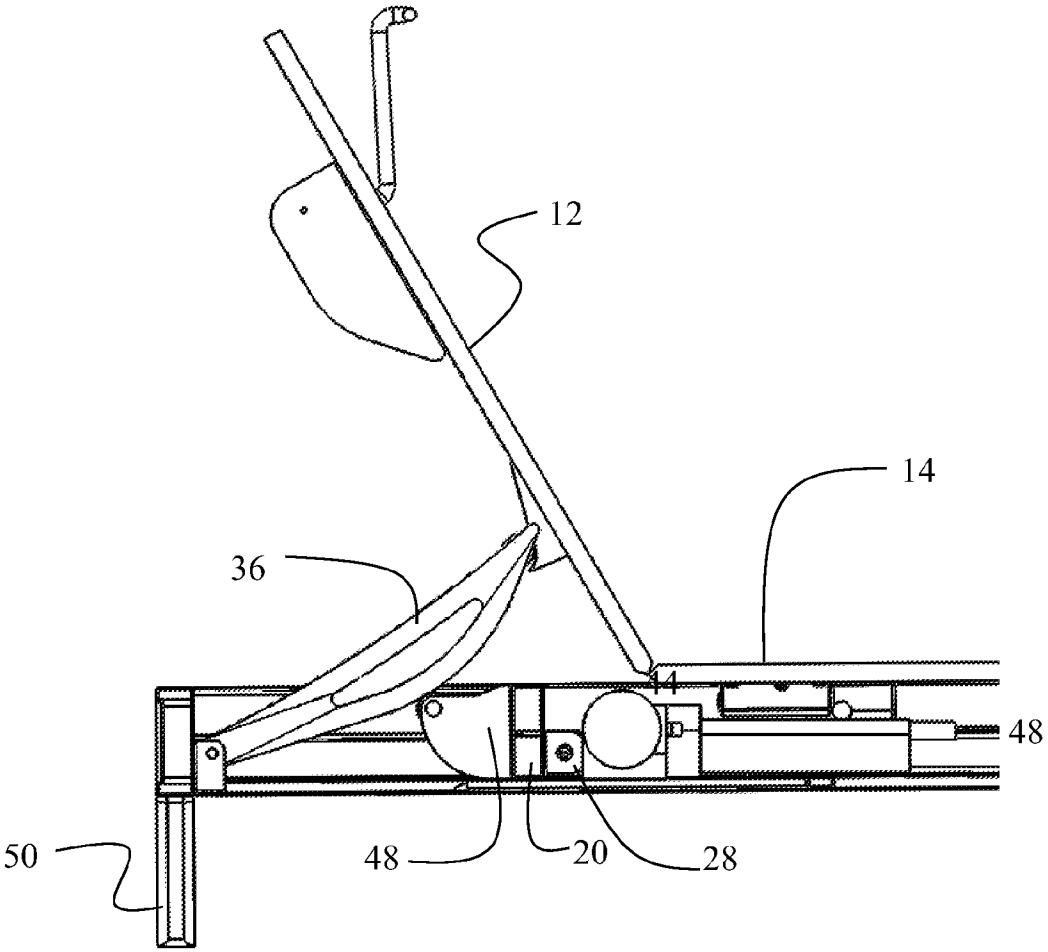
FIG. 2C is a detailed side view of the upper body actuation lever engagement with the carriage in fully articulated position.
Figure 2D:
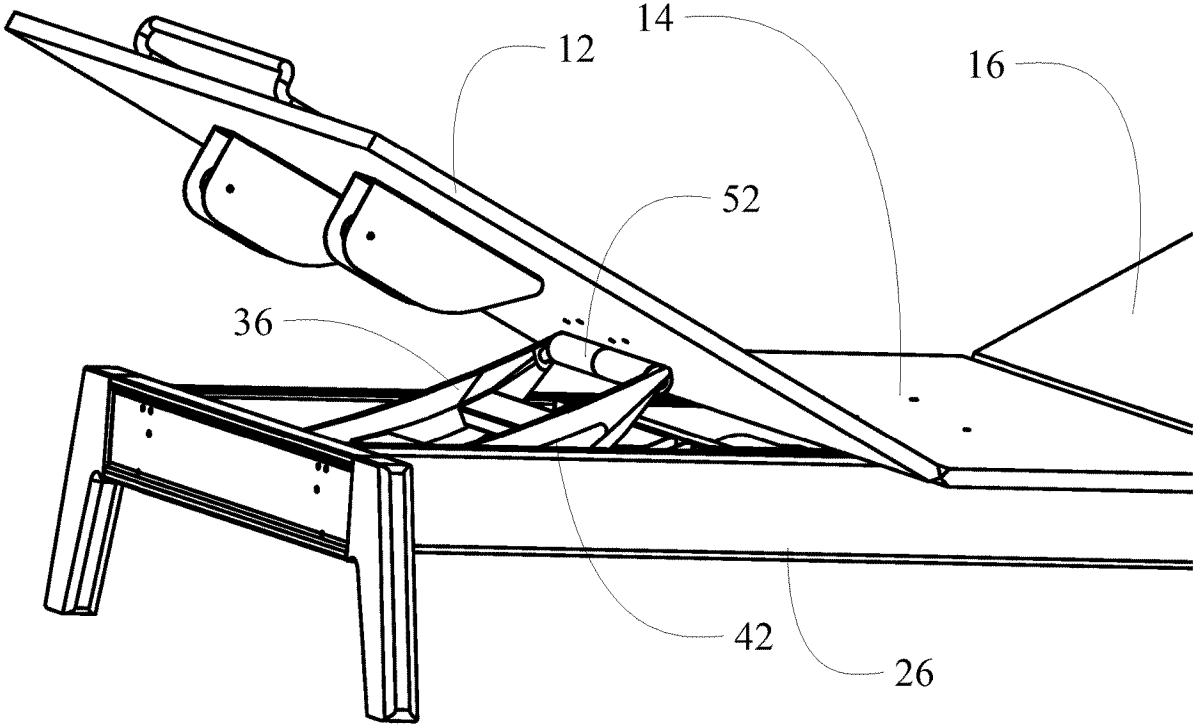
FIG. 2D is a detailed perspective view of the upper body actuation frame operating on the lower surface of the upper body support without a wedge.
Figure 2E:
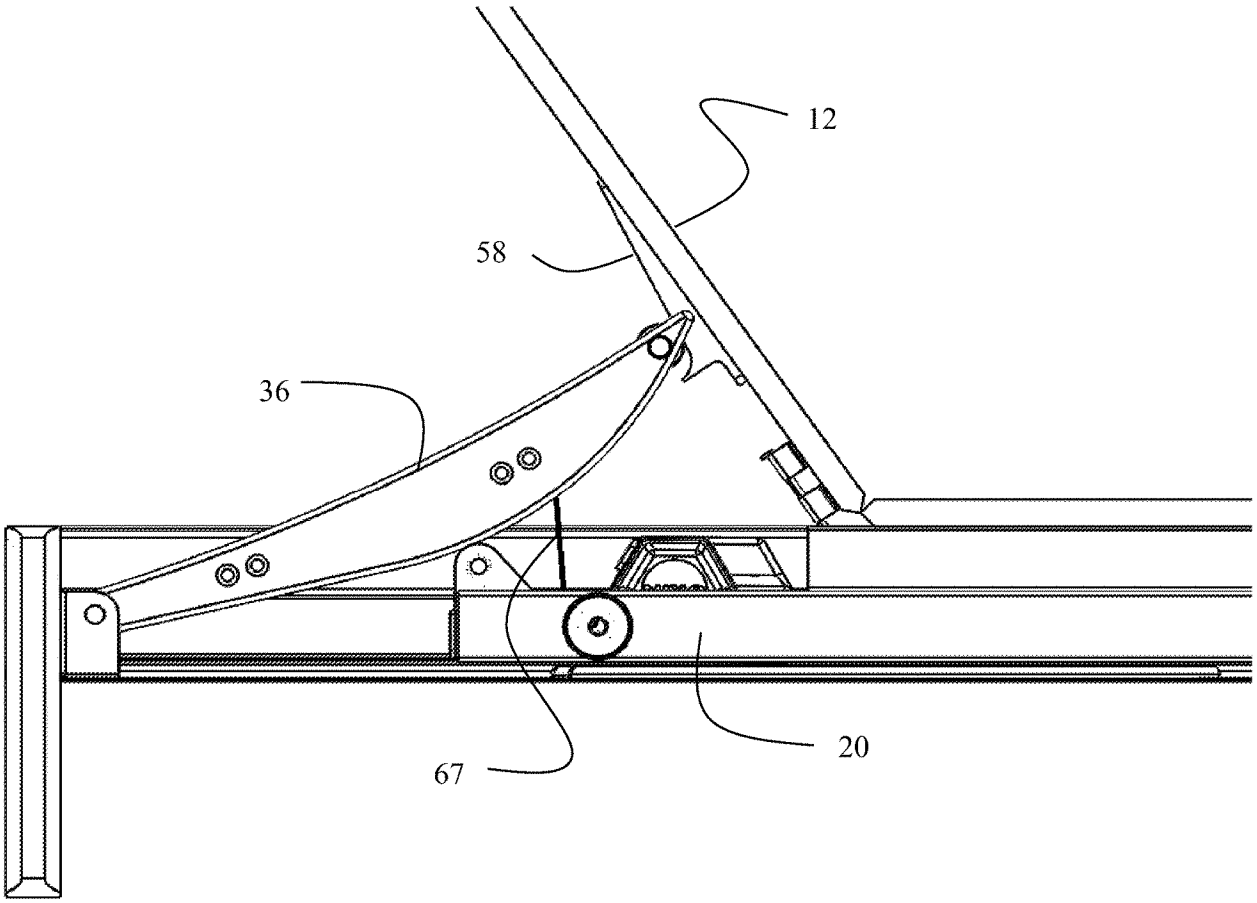
FIG. 2E is a detailed side view of the upper body actuation frame with a incorporating a limiting safety strap to avoid over-extension.
Figure 2F:
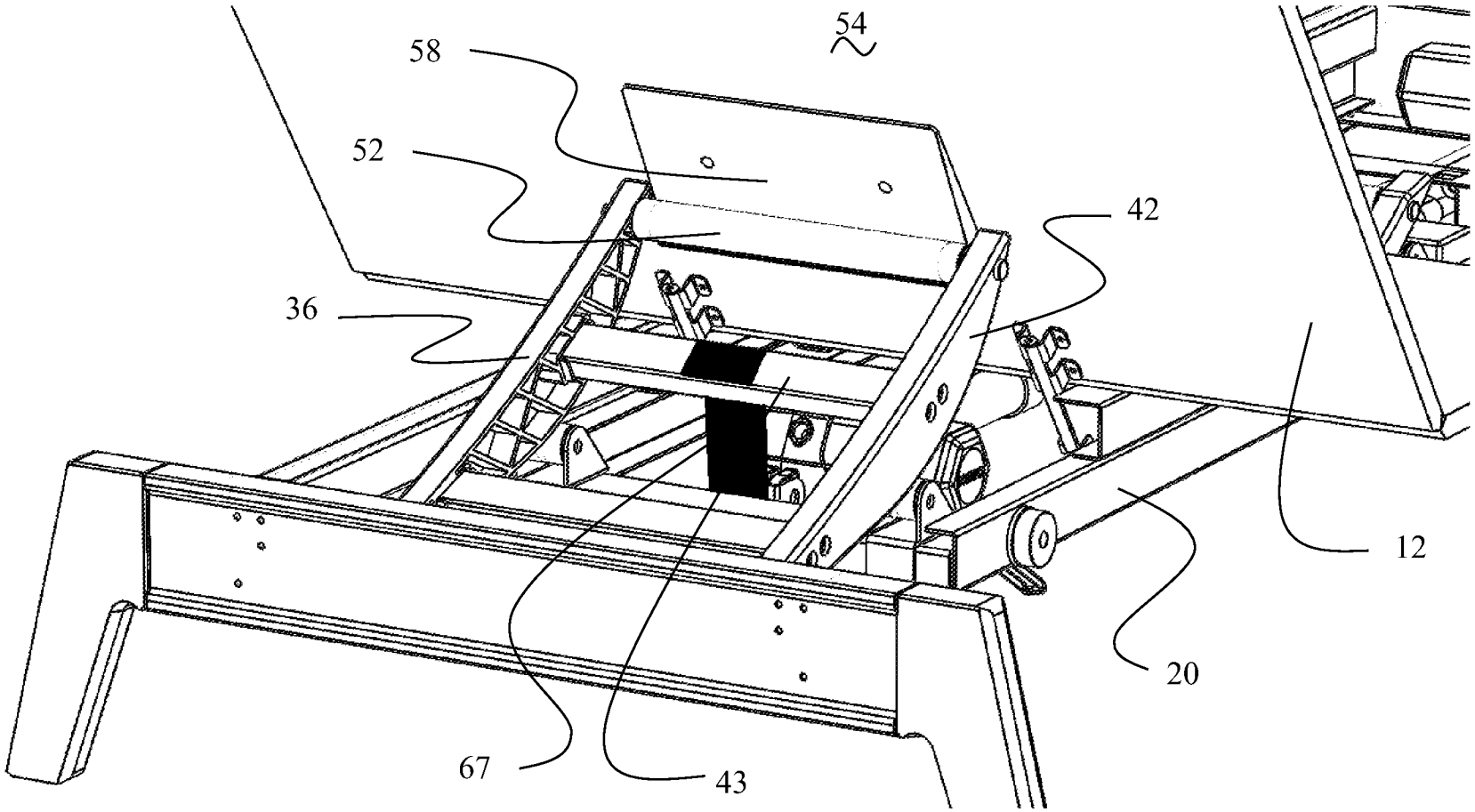
FIG. 2F is a detailed perspective view of the upper body actuation frame and the limiting safety strap.

The articulation sequence is shown for the upper body support 12 from an unarticulated position in FIGS. 1A and 2A with the carriage 20 in the first position through an intermediate articulation in FIGS. 1B and 2B, with the carriage translated to an intermediate position, to a fully articulated position in FIGS. 1C and 2C with the carriage in the fully translated position. The predetermined combination of the profile for the curved lower engagement surfaces 44 of the side blades 42 and the ramp angle 62 for ramp 60 mounted on the lower surface 54 of the upper body support 12 causes the head end 56 of the upper body support 12 to translate substantially vertically as the carriage translates thereby providing a "wall hugging" effect which is highly desirable to avoid creation of a gap between the upper body support head end 56 and wall adjacent the head end 50 of the bed. The upper body support in exemplary embodiments translates from 0° to 62° in a fully articulated position. As seen in FIGS. 1C and 2C, with the upper body support 12 fully articulated and the carriage 20 in the fully translated position, a hook 64 at a terminal end 66 of ramp 58 engages the second rollers 52 to prevent overextension. The embodiment shown in the drawings employs the wedge 58 for added flexibility in rate and angle control for the articulation of the upper body support. However, in alternative embodiments, the wedge is not employed and the articulation rate and angle is determined solely by the profile of the engagement surfaces of side blades 42 with the second roller 52 engaging the lower surface 54 of the upper body support as seen in FIG. 2D. As seen in FIGS. 2E and 2F, a woven "safety strap" 67 may be connected from one of the lateral ties 43 of the elevating frame 36 between the side blades 42 to the chariot 20 to prevent the side blades from overrotating or slipping upwards along the upper body support 12.

Figure 3A:
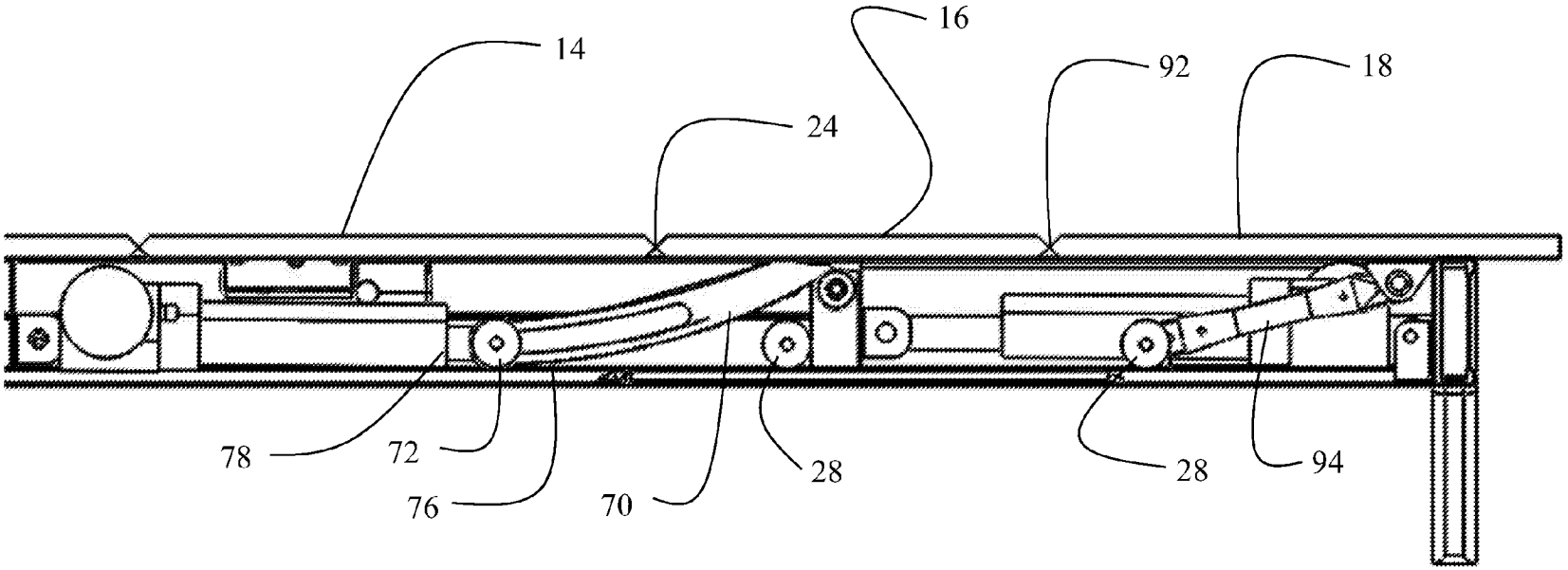
FIG. 3A is a detailed side view of the thigh and lower leg actuation elements in the unarticulated position.
Figure 3B:
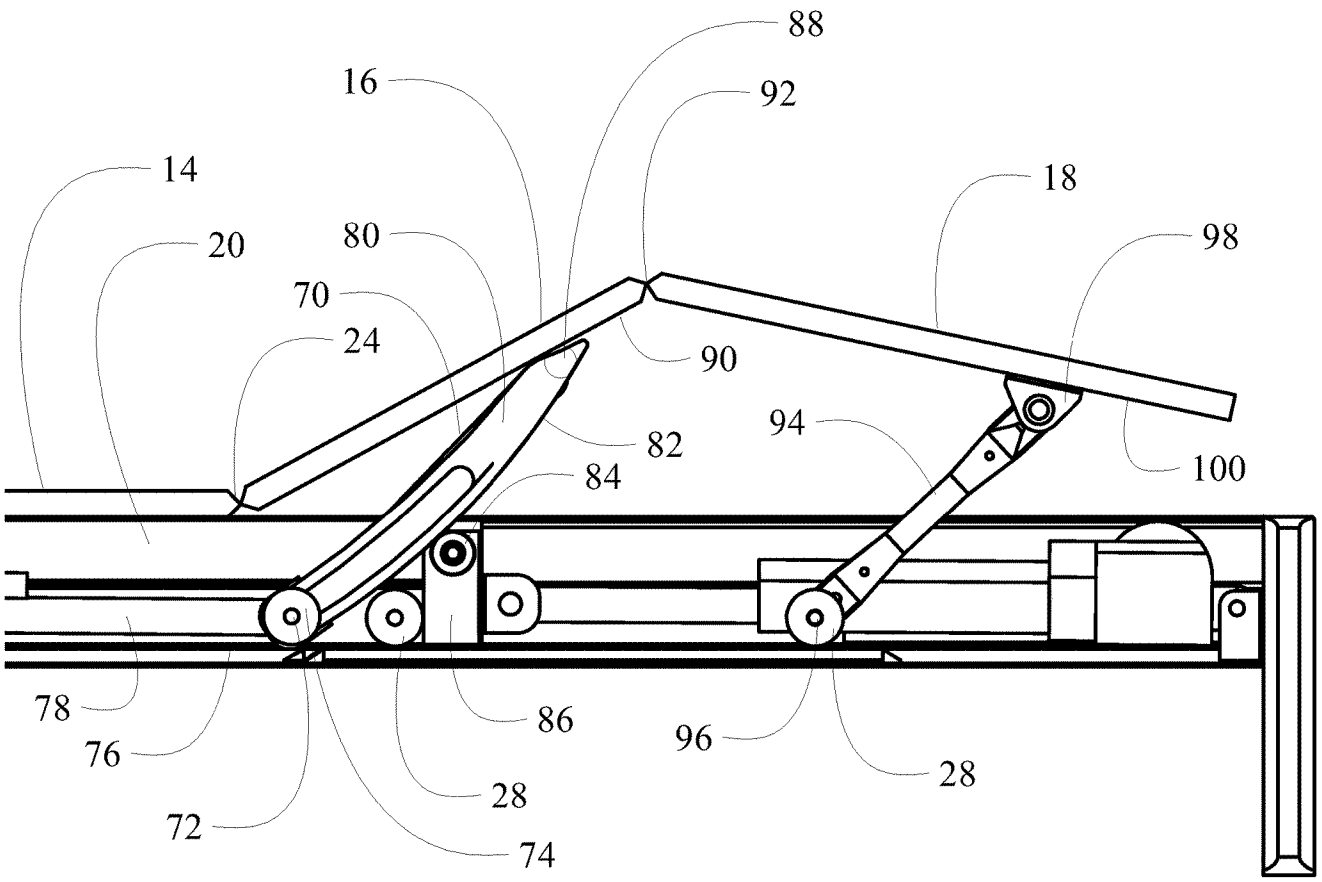
FIG. 3B is a detailed side view of the thigh and lower leg actuation elements in the articulated position.

The actuation elements for the articulation of the thigh support 16 and lower leg support 18 are carried by the carriage 20 to allow separate articulation from the upper body support 12. As seen in FIGS. 1A and 3A, a second elevating frame 70 rotates about a second axle 72. Second axle 72 is supported by second rollers 74 which engage a lower flange 76 on the carriage 20. As with the first elevating frame 36, the second elevating frame in an unrotated position as shown in FIGS. 1A and 3A has a thickness no greater than and is substantially concealed within the depth 41 of the profile of the side rails 26, A second actuator 78 attached within the carriage translates the second axle 72. Second side blades 80 in the second elevating frame have profiled lower surfaces 82 which engage third rollers 84 mounted to support blocks extending from the carriage lower flange 76. Translation of the second axle 72 from a first position as shown in FIGS. 1A and 3A toward the foot end of the bed to a fully translated position as seen in FIGS. 1C and 3B causes the second elevating frame to rotate about second axle 72 as the profiled lower surfaces 82 of second side blades 80 roll over third rollers 84. A four roller 88 engages a bottom surface 90 of the thigh support 16 which causes the thigh support to rotate about hinge 24 to articulate the thigh support. As with second roller 52, fourth roller 88 may be individual rollers attached to the second blades 80 or may be a single roller extending between the blades as shown in the drawings.

Lower leg support 18 articulates with the thigh support 16 rotating about a third hinge 92. Reaction rods 94 are pivotally mounted to axles 96, which for the embodiment shown are the axles of the foot end wheels 28 on the carriage 20, and extend to brackets 98 attached to a bottom surface 100 of the lower leg support 18. Upward articulation of the thigh support 16 causes the lower leg support 18 to be drawn toward the head of the bed 10 thereby rotating the reaction rods 94 which elevate the foot end of the lower leg support. Operation of the articulation elements of the thigh support 16 and lower leg support 18 can be accomplished through the entire range of articulation with the carriage 20 at any translation position.

Figure 1E:
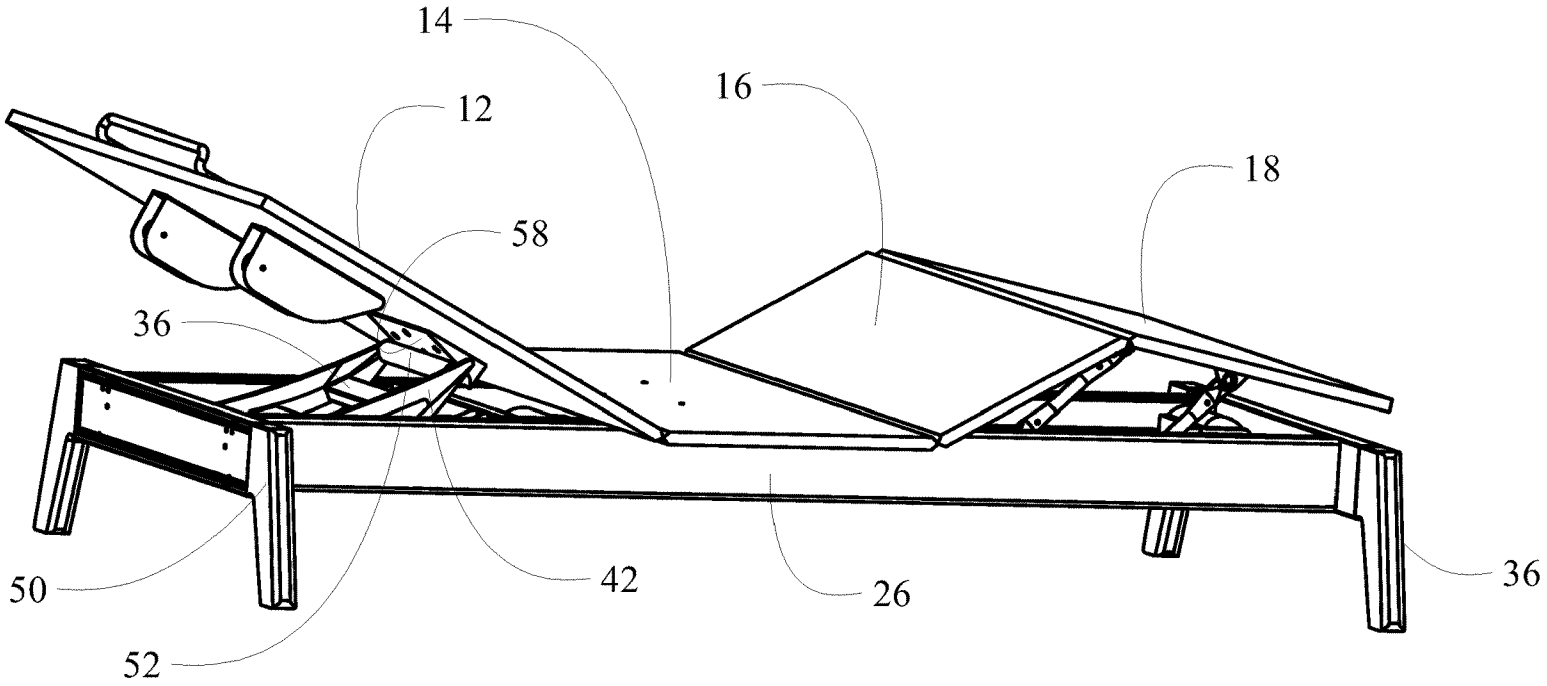
FIG. 1E is a pictorial view of the adjustable bed system in a partially articulated position.
Figure 4:
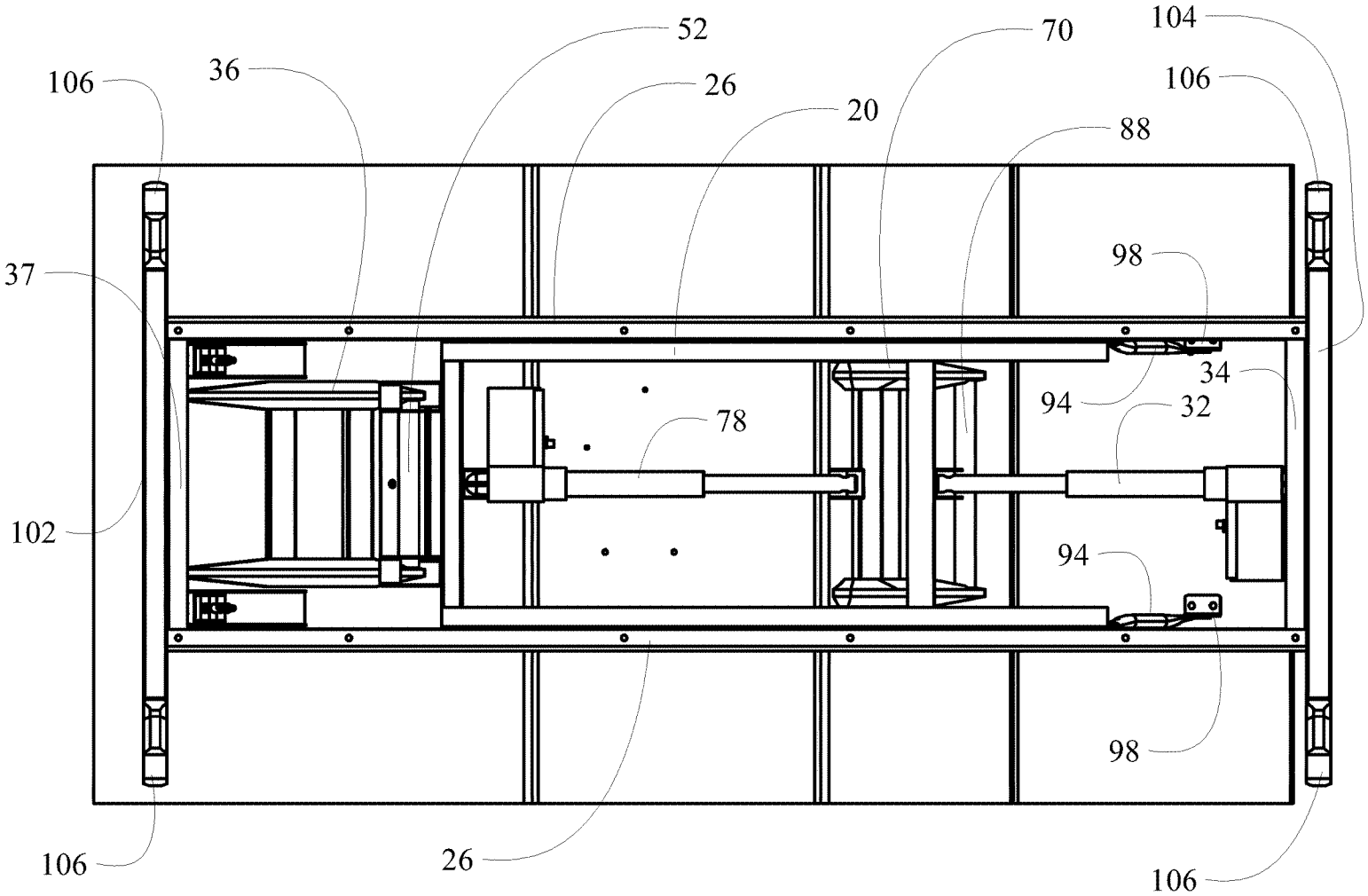
FIG. 4 is a bottom view of the bed.

As seen in FIG. 4, the structure of the compact profile actuation system allows not only a reduced vertical profile to allow side rails with minimal depth to effectively hide the actuation elements in the unarticulated position but also allows the support frame elements of the bed to have significantly reduced width. The first elevation frame 36 and second elevation frame 70 may have any desired width limited only by the required torsional rigidity imparted to the mattress support elements. The alignment of the first and second actuator on the centerline of the frame intermediate the two side rails 26 allows the width between the side rails to be narrowed with the relative width of the actuators being the only limiting factor. The side rails 26 may then be mounted to transverse head end rail 102 and foot end rail 104 which may extend to support legs 106 completing the support frame. As seen in FIG. 1E this allows the bed 10 to have a unique pedestal configuration with the articulating mattress support elements appearing to float above the legs The unique structure of the actuation system 10 allow the same profile to be retained with multiple bed sizes; twin, queen and king or matched twin. Replacement of the upper body support 12, seat support 14, thigh support 16 and lower leg support 18 with appropriate width panels is all that is required.

Figure 5A:
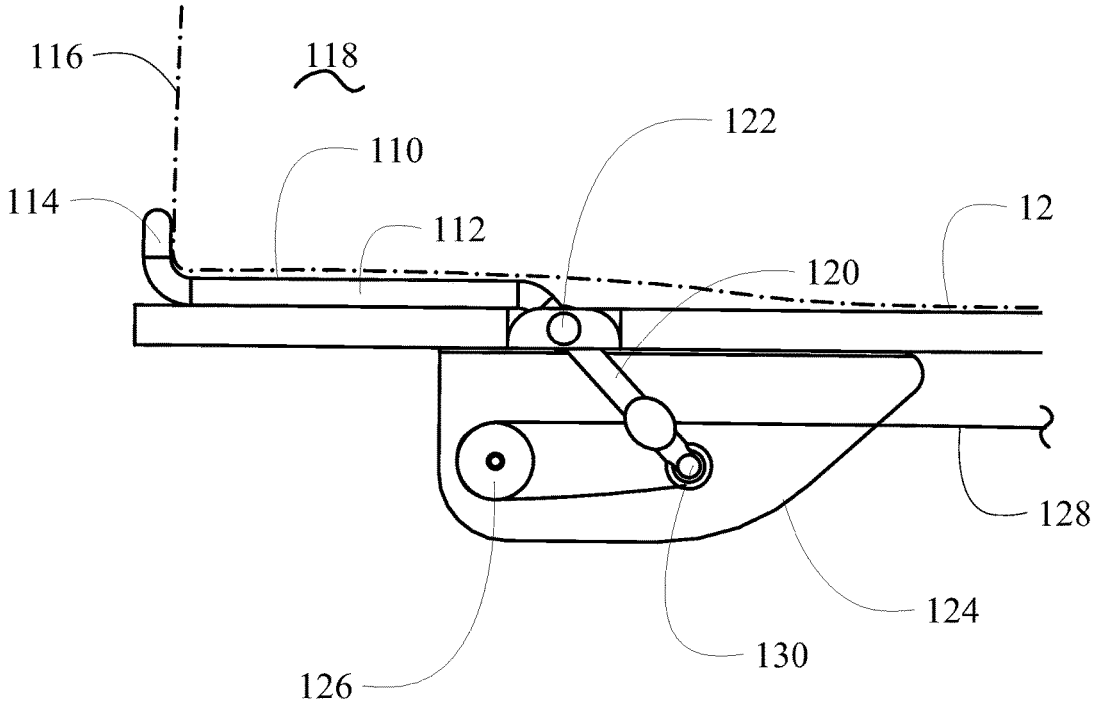
FIG. 5A is a detailed side view of the mattress head tilt frame in the unarticulated position.
Figure 5B:
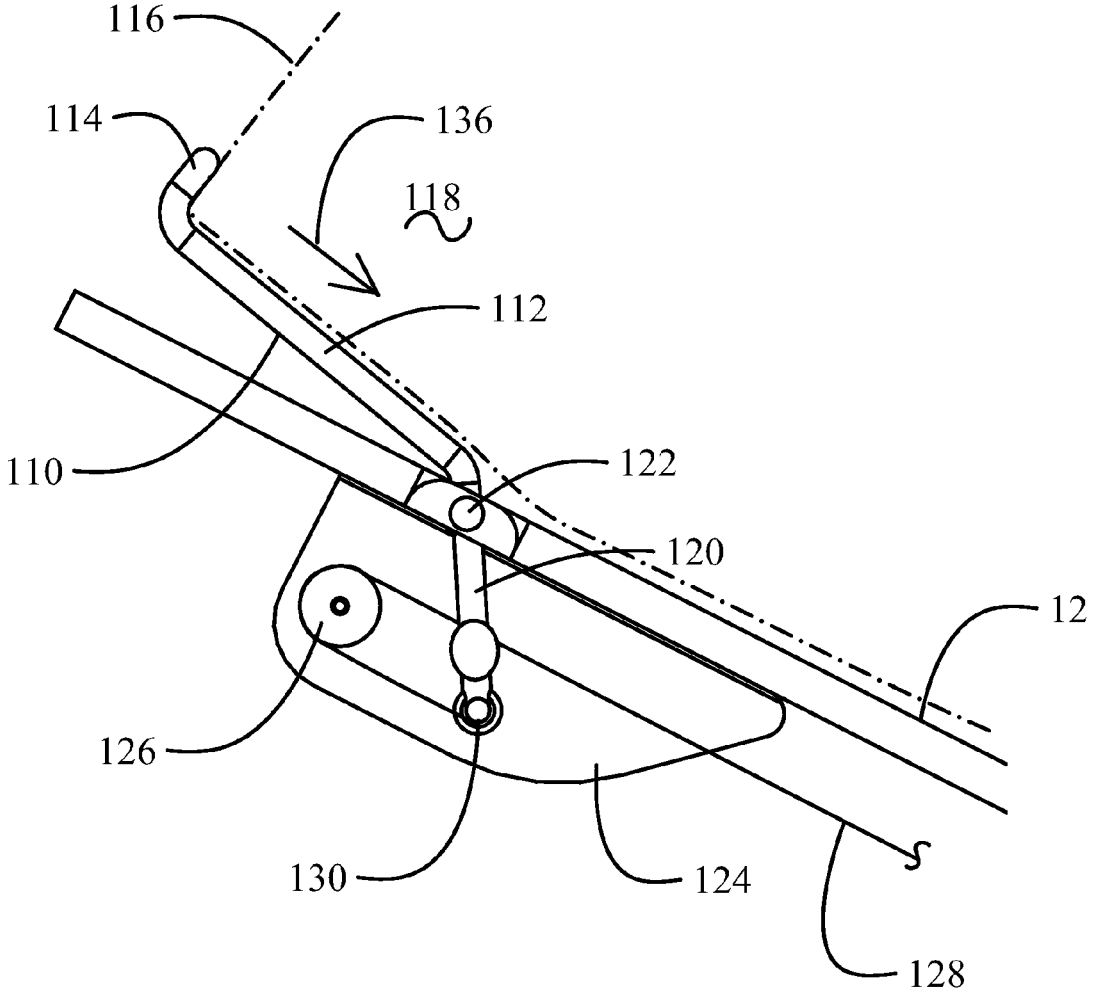
FIG. 5B is a detailed side view of the mattress head tilt frame in the partially articulated position.
Figure 5C:
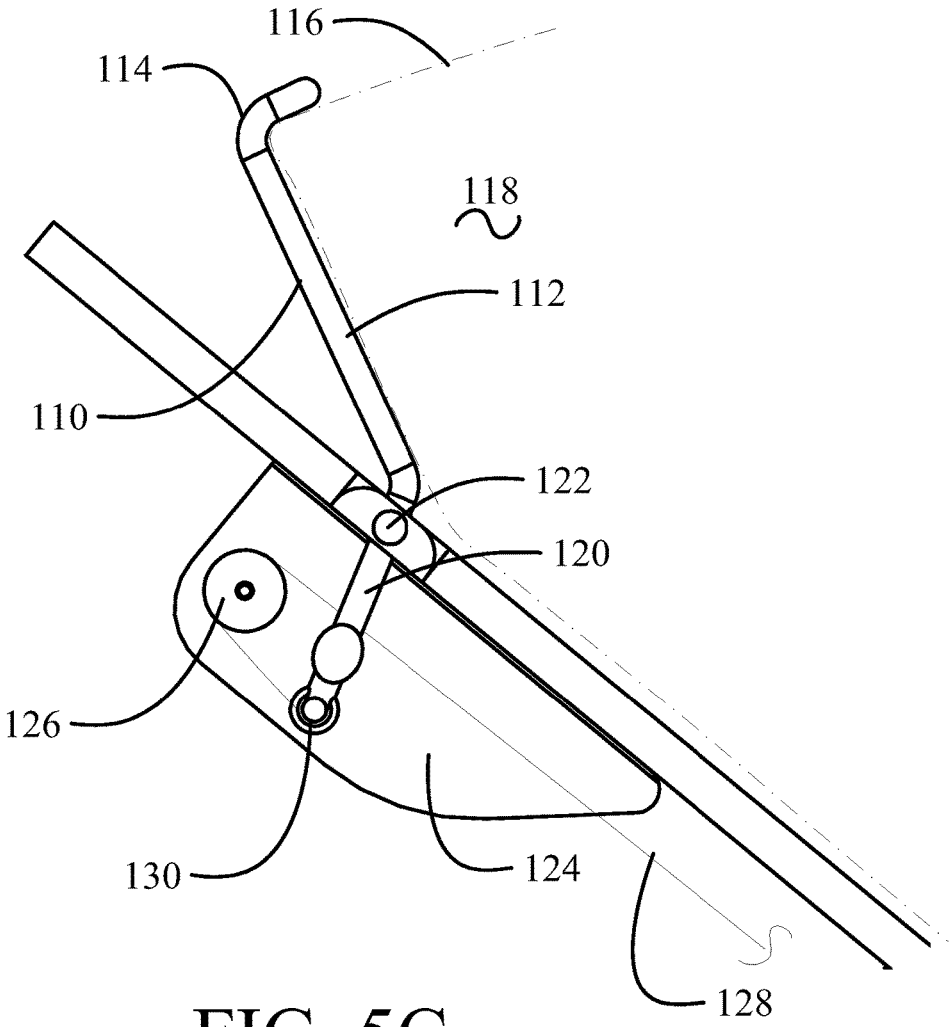
FIG. 5C is a detailed side view of the mattress head tilt frame in the fully articulated position.
Figure 5D:
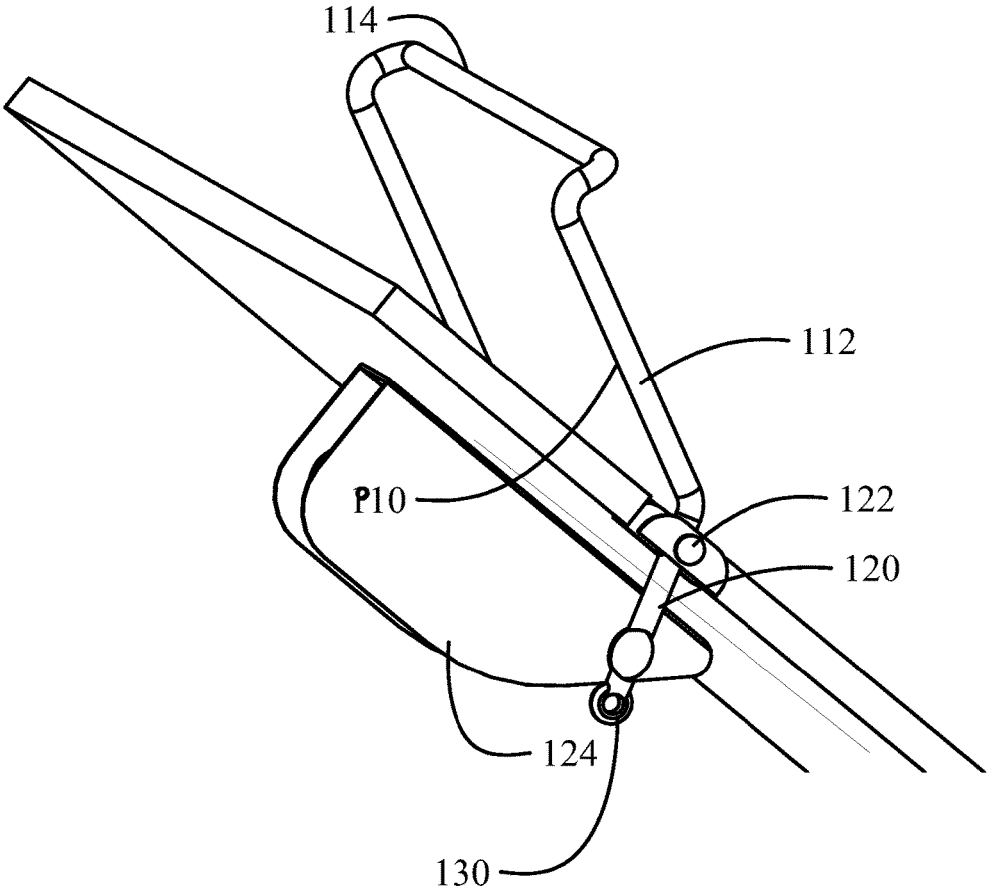
FIG. 5D is a pictorial representation of the head tilt frame with the upper body support sectioned and the left bracket removed to show the details of the head tilt frame elements; and, FIG. 5E is a bottom view showing an alternative linear actuator driven cable for head tilt.

The compact profile actuation system additionally provides an automatic head tilt feature for the mattress as seen in detail in FIGS. 5A-5D. A head tilt frame 110 is pivotally mounted in the upper body support element 12. Side arms 112 support an angled cross member 114 which is mounted between the arms and extends upward to engage a head end 116 of the mattress 118. Angled levers 120 extend from each side arm substantially at a pivot 122. A housing 124 supports a pulley 126 and a cable 128 extends around the pulley from a fitting 130 on a distal end of each angled lever 120. The cable runs substantially parallel to the bottom surface 54 of the upper body support element 12 and runs over a second pulley 132 (seen in FIGS. 2A-2C) to a termination 134. As the head support 12 articulates, the cable 128 maintains a constant tension which results in rotation of the angled levers 120 about the pivot 122 thereby rotating the side arms 112 upward. As seen in FIGS. 5A-5C, articulation of the upper body support 12 rotates the head tilt frame from a flush position in FIG. 5A through an intermediate rotation position shown in FIG. 5B to a fully rotated position seen in FIG. 5C. The angled cross member 114 maintains a longitudinal force (as represented by arrow 136) to prevent the mattress from lifting from the upper body support 12.

Figure 5E:
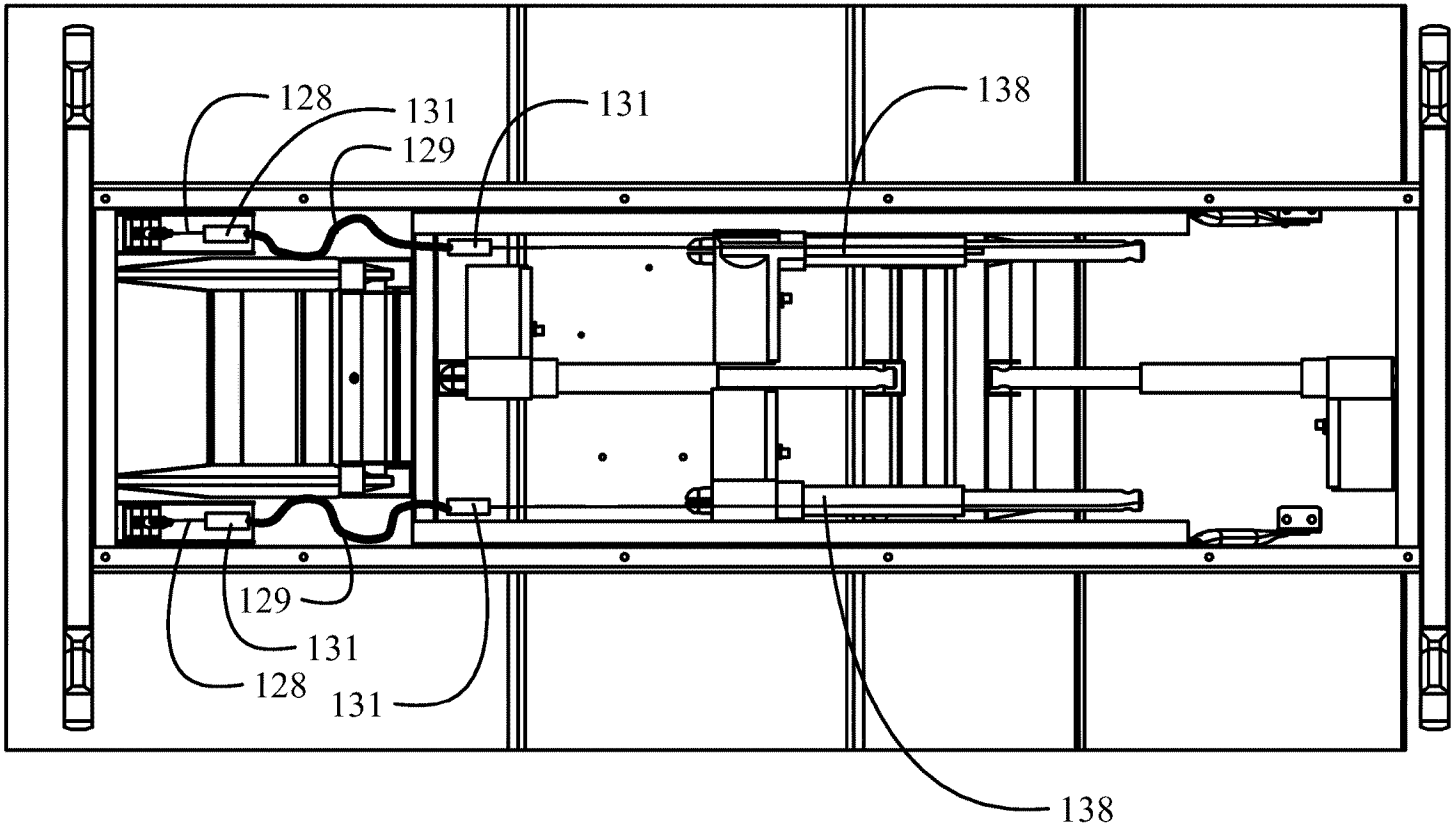

Alternatively, positioning of the head-tilt can be user-selected. Rather than terminating under the seat section 14 at a fixed point termination 134 with the cable assembly under constant tension connected at the fitting 130, the cable 128 is surrounded by a jacket 129 with ferrules 131 at each end as seen in FIG. 5E, with some slack to allow the upper body support 12 to articulate up/down without engaging the head-tilt frame 110 for rotation. The actuating end of the cable 128 is attached to at least one linear actuator 138 mounted on the carriage 20. The linear actuator applies tension to the cable 128 allowing the head tilt to engage.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. An articulating bed comprising:

a support frame with a head end and having side frame members;

a carriage having a seat support and carried by the side frame members, said carriage mounted with wheels engaging the side frame members to translate from a first position through a range progressing toward the head end to a fully translated position;

a first actuator connected to a foot end of the support frame and operably engaging the carriage for translation;

a first elevating frame rotating about an axle attached to the side frame members, said first elevating frame concealed within a depth profile of the side frame members in an unrotated position;

first rollers carried by the carriage and engaging lower profile surfaces of the elevating frame;

a second roller carried by the first elevating frame and engaging a lower surface of an upper body support pivotally attached to the seat support, whereby translation of the carriage from the first position to the fully translated position rotates the first elevating frame about the axle as the lower profile surfaces roll over the first rollers to articulate the upper body support.

2. The articulating bed as defined in claim 1 further comprising a wedge mounted to the lower surface of the upper body support, the second roller engaged by the wedge on a ramp having an angle predetermined in combination with the lower profile surfaces to rotate the upper body support whereby a head end translates substantially vertically.

3. The articulating bed as defined in claim 2 wherein the ramp terminates in a hook engaging the second roller in the fully translated position.

4. The articulating bed as defined in claim 1 further comprising:

a second elevating frame carried in the carriage and rotatable about a second axle, the second elevating frame in an unrotated position having a thickness no greater than and substantially concealed within the depth of the profile of the side rails;

second rollers receiving the second axle and engaging a lower flange on the carriage;

a second actuator attached within the carriage to operably translate the second axle;

third rollers mounted to the carriage engaging profiled lower surfaces of the second elevating frame;

a fourth roller engaging a bottom surface of the thigh support pivotally attached to the seat support, whereby translation of the second axle from a first position toward a foot end of the support frame through a range to a fully translated position causes the second elevating frame to rotate about second axle as the profiled lower surfaces of the second side blades roll over the third rollers thereby causing the thigh support to rotate to articulate the thigh support.

5. The articulating bed as defined in claim 1 further comprising:

a head tilt frame having side arms mounted with a pivot in the upper body support;

an angled cross member supported between the side arms and extending upward to engage a head end of a mattress;

angled levers extending from the side arms proximate the pivot;

a pulley mounted to the upper body support; and, a cable extending around the pulley from a fitting on a distal end of each angled lever, the cable running substantially parallel to the bottom surface of the upper body support over a second pulley mounted on the carriage to a termination, whereby as the head support articulates, the cable maintains a constant tension which results in rotation of each angled lever about the pivot thereby rotating the side arms upward.

6. The articulating bed as defined in claim 5 further comprising:

a lower leg support pivotally attached to the thigh support distal from the seat support;

reaction rods pivotally mounted the carriage and extending to brackets attached to a bottom surface of the lower leg support, whereby upward articulation of the thigh support causes the lower leg support to be drawn toward the head end thereby rotating the reaction rods which elevate the foot end of the lower leg support.

7. The articulating bed as defined in claim 1 further comprising:

a head tilt frame having side arms mounted with a pivot in the upper body support;

an angled cross member supported between the side arms and extending upward to engage a head end of a mattress;

angled levers extending from the side arms proximate the pivot;

a pulley mounted to the upper body support; and, a cable extending around the pulley from a fitting on a distal end of each angled lever, the cable running substantially parallel to the bottom surface of the upper body support and having a sleeve with ferules;

at least one linear actuator carried by the carriage and attached to the cable, said at least one linear actuator applying tension to the cable through the sleeve for rotation of the angled levers.

8. The articulating bed as defined in claim 1 further comprising a safety strap engaged between the first elevating frame and carriage, said safety strap limiting rotation of the first elevating frame.

* * * * *